US005542219A

United States Patent [19]

Dias

[11] Patent Number: 5,542,219

[45] Date of Patent: Aug. 6, 1996

[54] WALL PANEL INTERLOCK LEVELING DEVICE

[75] Inventor: Gary R. Dias, Folsom, Calif.

[73] Assignee: California Prison Industry Authority, Folsom, Calif.

[21] Appl. No.: 187,402

[22] Filed: Jan. 25, 1994

[51] Int. Cl.[6] ..... E04B 2/82; E04H 1/00; F16B 1/00

[52] U.S. Cl. ..... 52/126.4; 52/36.1; 52/239; 52/282.2; 160/351; 248/188.4

[58] Field of Search ..... 52/36.1, 126.1, 52/126.3, 126.4, 239, 241, 264, 270, 272, 274, 282.2, 284, 293.3, 656.1; 160/135, 351; 248/188.2, 188.4

[56] References Cited

U.S. PATENT DOCUMENTS

| | | |
|---|---|---|
| 3,713,257 | 1/1973 | Beavers . |
| 3,990,204 | 11/1976 | Haworth et al. . |
| 4,241,965 | 12/1980 | Wilson et al. . |
| 4,277,123 | 7/1981 | Haworth et al. . |
| 4,367,370 | 1/1983 | Wilson et al. . |
| 4,485,602 | 12/1984 | Flamboe, Jr. et al. . |
| 4,596,098 | 6/1986 | Finkbeiner et al. . |
| 4,644,992 | 2/1987 | Jerila . |
| 4,666,223 | 5/1987 | Tillmann . |
| 4,703,985 | 11/1987 | Finkbeiner et al. . |
| 4,775,125 | 10/1988 | Pfeifer . |
| 4,993,205 | 2/1991 | Dull et al. . |
| 4,996,811 | 3/1991 | Dull et al. . |
| 5,033,526 | 7/1991 | DeLong et al. . |
| 5,054,255 | 10/1991 | Maninfior . |

FOREIGN PATENT DOCUMENTS

| | | |
|---|---|---|
| 0292833 | 11/1988 | European Pat. Off. . |

OTHER PUBLICATIONS

Haworth Installation Procedures, 1982, Haworth, Inc.
System XXI Panel Installation Instructions; Undated.

*Primary Examiner*—Wynn Wood
*Assistant Examiner*—Kevin D. Wilkens
*Attorney, Agent, or Firm*—John P. O'Banion

[57] ABSTRACT

An apparatus for leveling and aligning wall panels. The apparatus includes upper and lower interlocking tab assemblies, each positioned on the vertical edge of each wall panel. Each tab assembly includes a pair of vertically and horizontally offset tabs, which mate with complementary tabs on an adjoining wall panel. The invention allows wall panels to be joined and aligned, and also permits adjacent panels to be pivotally oriented relative to one another about a vertical axis.

6 Claims, 5 Drawing Sheets

WALL PANEL INTERLOCK LEVELING DEVICE

BACKGROUND OF THE INVENTION

1. Field of the Invention

This invention pertains generally to connecting and leveling modular wall panels, and more particularly to an interlocking leveling device having paired complementary tabs which interlock and level the ends of adjoining wall panels.

2. Description of the Background Art

Wall structures formed from a plurality of prefabricated interconnected and portable wall panels are used extensively in commercial and industrial buildings for dividing interior regions into smaller work regions. The wall panels are typically connected end-to-end, and the end joints often include hang-on type bracket supports for mounting desks, work surfaces, shelves, file cabinets, and other modular components to the wall structure. As a result, the wall panels must be level and employ a sturdy coupling between their end joints.

A number of variations in wall panel leveling systems have been heretofore developed. For example, U.S. Pat. No. 3,990,204 discloses an alignment system for wall panels having a alignment member with right and left horizontal plates associated with each panel. The plates are offset vertically so that the horizontal plates from alignment members of adjacent panels interfit. U.S. Pat. No. 4,485,602 discloses a wall panel positive alignment device having a central vertical mounting column, vertically offset alignment ledges, and a wall panel support ledge. Identical alignment devices engage in adjacent wall panels.

Current wall panel leveling and alignment systems, however, require time consuming adjustments to achieve level panels. Additionally, the often substantial loads placed on the leveling and alignment systems from modular components attached to the wall structure can result in mechanical failure at strategic parts of the systems. Further, many wall panel leveling systems are unsightly and visually incompatible with work environments. Therefore, there is a need for a leveling device for wall panels which is easy to adjust, which provides substantial load carrying capability, and which does not have unsightly aesthetic characteristics. The present invention satisfies that need, as well as others, and overcomes the deficiencies found in prior attachment systems.

The foregoing patents reflect art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains to an interlock leveling device for wall panels which is mounting at the lower corner of a wall panel and which engages an identical device in an adjacent wall panel. In general terms, the invention includes a base which serves as a panel support, a height adjustment mechanism associated with the base, a lower pair of alignment tabs, and upper pair of alignment tabs vertically offset from the lower pair of alignment tabs, and means for attaching the device to a wall panel. In a first embodiment of the invention, the upper and lower pairs of alignment tabs are both coupled to the base to form an integral unit. In a second embodiment of the invention, the lower pair of alignment tabs are coupled to the base whereas the upper pair of alignment tabs is separately coupled to the wall panel.

By way of example and not of limitation, each pair of alignment tabs include upper and lower tabs which are both vertically and horizontally offset in relation to each other. The plane of the bottom surface of the upper tab is adjacent to the plane of the top surface of the lower tab. The base includes a threaded insert for inclusion of an adjustable threaded glide for adjusting the height of the panels. When the ends of wall panels are adjoined, the panels engage and interlock in a level position as the lower and upper pairs of tabs from one panel are coupled to the lower and upper pairs of leveling tabs of an adjacent panel. The height adjustment mechanism can be raised or lowered to fine-tune the panel level by movement of the adjustable glide in relation to the base.

An object of the invention is to provide an interlock leveling device for wall panels that is visually unobtrusive and aesthetically pleasant.

Another object of the invention is to provide an interlock leveling device for wall panels that allows facile, time-efficient leveling of panels.

Another object of the invention is to provide an interlock leveling device for wall panels that distributes the weight of panels in a manner that avoids mechanical failure of load bearing portions of the leveler.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 6. It will be appreciated that the apparatus may vary as to configuration and as to details of the parts without departing from the basic concepts as disclosed herein.

Figure 1:
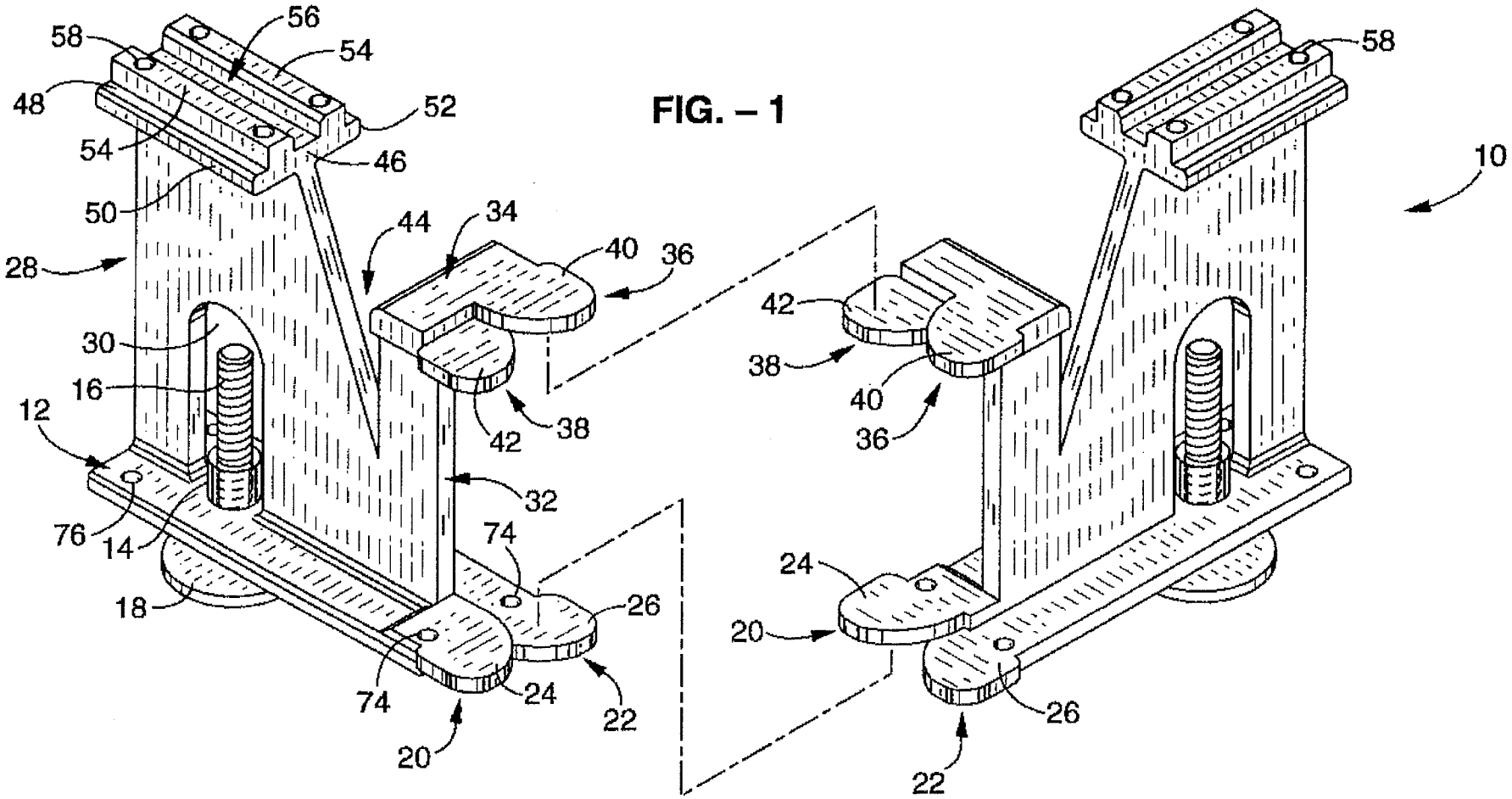
FIG. 1 is a perspective diagrammatic view showing two disengaged interlock leveling devices in accordance with the present invention oriented for coupling in a right angle configuration.
Figure 2:
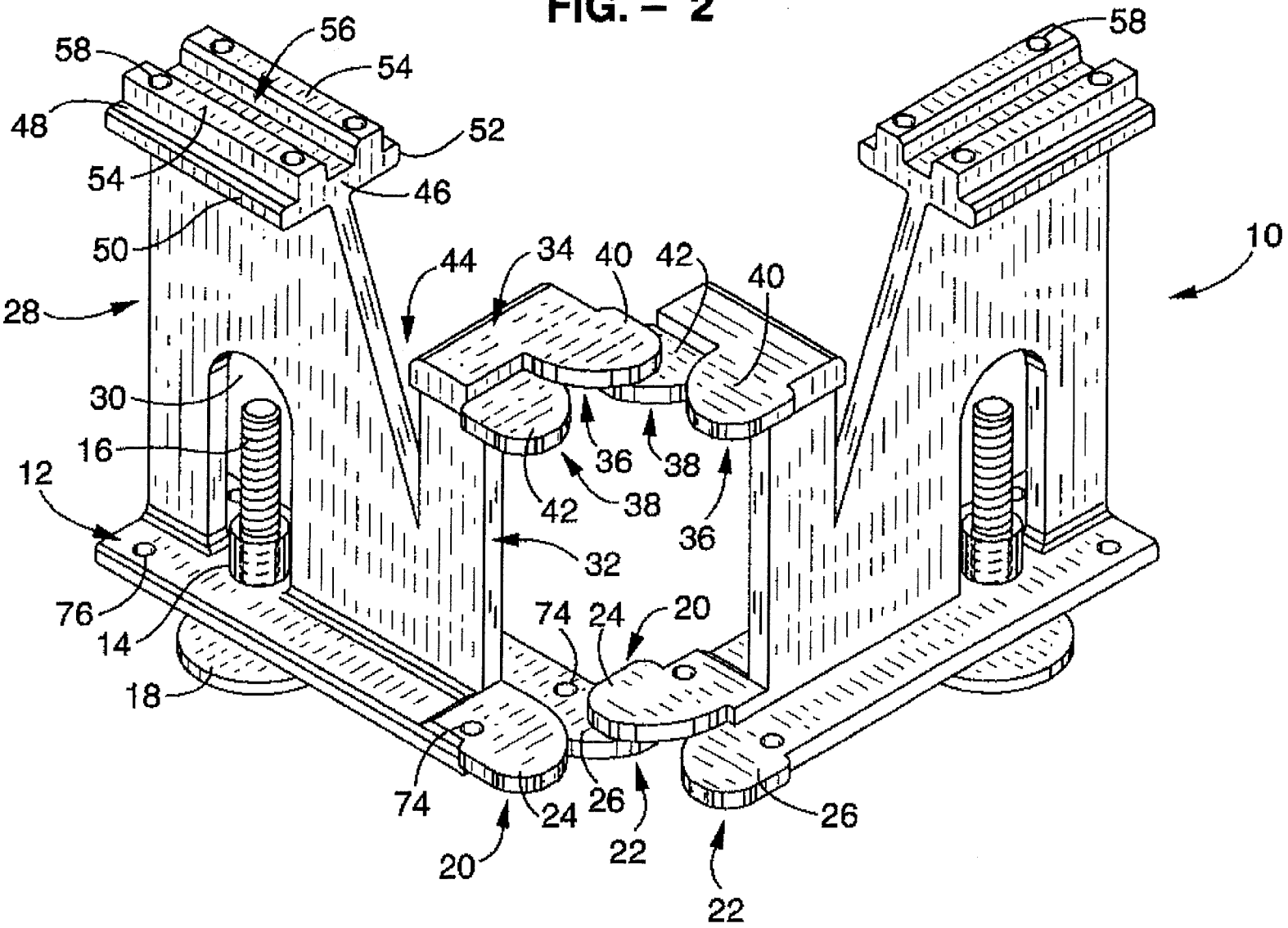
FIG. 2 is a perspective view showing the interlock leveling devices of FIG. 1 engaged in a right angle configuration.

Referring to FIG. 1 and FIG. 2, there are illustrated two interlocking levelers 10 in disengaged and engaged positions, respectively, oriented for coupling wall panels in a right angle configuration. Each interlock leveler 10 includes a base platform 12, preferably of flattened rectangular configuration. A vertical circular threaded bore 14 in the base platform 12 receives a threaded bolt 16. Fixedly coupled to the lower end of bolt 16 is a height adjustment foot 18, preferably in the form of a flattened disc-shaped pad as shown. Rotation of height adjustment foot 18 thereby raises or lowers base platform 12.

The apparatus also includes a lower leveling tab assembly having a first upper tab 20 and a first lower tab 22 which are joined to and extend outward from base platform 12. First upper tab 20 has a top face 24 and a bottom face (not shown), and first lower tab 22 has a top face 26 and a bottom face (not shown). First upper tab 20 and first lower tab 22 are offset both horizontally and vertically in relation to each other, so that the plane of the bottom face (not shown) of first upper tab 20 is vertically adjacent to the plane of top face 26 of first lower tab 22.

Joined to and extending vertically from base platform 12 is rear support member 28. A notch 30 is included in rear support member 28 to provide room for positioning threaded bolt 16 mounted to height adjustment foot 18. Joined to and extending vertically from base platform 12 is a front support member 32. Joined to the upper end of front support member 32 is a generally horizontal planar ledge 34.

The apparatus also includes an upper leveling tab assembly having a second upper tab 36 and a second lower tab 38 which are joined to and extend outward from ledge 34. Second upper tab 36 has a top face 40 and a bottom face (not shown), and second lower tab 38 has a top face 42 and a bottom face (not shown). Second upper tab 36 and second lower tab 38 are offset both horizontally and vertically in relation to each other, so that the plane of the bottom face (not shown) of second upper tab 36 is vertically adjacent to the plane of top face 42 of second lower tab 38. Additionally, first upper tab 20 is positioned directly beneath second lower tab 38 in vertical alignment, and first lower tab 22 is positioned directly beneath second upper tab 36 in vertical alignment. Further the faces of first upper tab 20 are parallel to the faces of second lower tab 38, and the faces of first lower tab 22 are parallel to the faces of second upper tab 36. Therefore, the upper leveling tab assembly is vertically offset from the lower leveling tab assembly.

It can be seen, therefore, that rear support member 28 and front support member 32 form a support structure for the upper and lower leveling tab assemblies. If desired, rear support member 28 can be separated from front support member 32 by a V-shaped notch 44 or the like to in order to decrease the overall weight of the interlock leveler 10 in a manner that does not reduce the load bearing capacity of the front and rear support members.

Further, rear support member 28 includes means for attachment to a wall panel component. Preferably, the means for attachment is an upper support platform 46 having a top face 48, and first and second edges 50 and 52. Preferably, two parallel longitudinal ridges 54 run across the top face 48, and the two longitudinal ridges 54 form a longitudinal channel 56 in between them. A plurality of holes 58 are also provided for use for use with conventional fasteners for coupling to the inner frame structure of a wall panel.

In order to engage and level two adjacent panel components in a right angle configuration, as shown in FIG. 1 and FIG. 2, second upper tab 36 of one (a first) interlock leveler 10 fits over second lower tab 38 of an adjacent (a second) interlock leveler 10, so that the lower surface (not shown) of second upper tab 36 fits intimately against the upper surface 42 of second lower tab 38. Likewise, the corresponding first lower tab 22 of the first interlock leveler 10 fits under the corresponding first upper tab 20 of the adjacent interlock leveler 10, so that the top face 26 of first lower tab 22 fits intimately against the bottom face (not shown) of the first upper tab 20.

Thus, the second upper and first lower tabs 36 and 22 of one interlock leveler are fitted in between the second lower and first upper tabs 38 and 20, respectively, thereby achieving an interfitting and interlocking engagement. It will also be appreciated that, while FIG. 1 and FIG. 2 depict a right angle configuration, a straight line configuration would result in the interfitting of all of the corresponding tabs in the adjacent interlock levelers 10.

Since second upper and lower tabs 36 and 38 are well spaced apart vertically from first upper and lower tabs 20 and 22, once the aforementioned interfitting and interlocking engagement position is achieved, the panel components attached to the interlock levelers 10 will be in a generally level position. The height adjustment foot 18 on each interlock leveler can be adjusted by turning the threaded bolt 16 in order to fine tune the panel leveling, and to compensate for any irregularities in the floor surfaces beneath the panels.

Preferably, when an interlock leveler 10 is attached to a wall panel, the majority of the weight of the wall panel will be received by upper support platform 46 and distributed through rear support member 28 to base platform 12. It is contemplated, however, that some of the weight will be received by second upper and lower tabs 36 and 38 and distributed through front support member 30 to base platform 12. Further, it is preferred that the interlock leveler 10 be enclosed by a wall panel so only that tabs 20, 22, 36 and 38 and vertical adjustment foot 18 are exterior to the panel component. In this regard, the length of tabs 20, 22, 36 and 38 must be such that, when two wall panels are adjoined in a straight-line configuration, the tabs on one wall panel do not bottom out against the adjacent wall panel so as to create a gap between the panels. Further, the width of the upper and lower tab assemblies must not be greater than the thickness of the wall panel, so as to ensure that the tabs do not extend beyond the faces of the wall panel. Lastly, tabs 20, 22, 36 and 38 must be of such a size and shape that, when wall panels are adjoined at a right angle as shown herein, engagement of the tabs is still possible. This arrangement minimizes visual exposure of the interlock leveler 10, thereby minimizing any obtrusive unaesthetic mechanical appearance, while still permitting the wall panels to be interconnected at a variety of angles.

Figure 3:
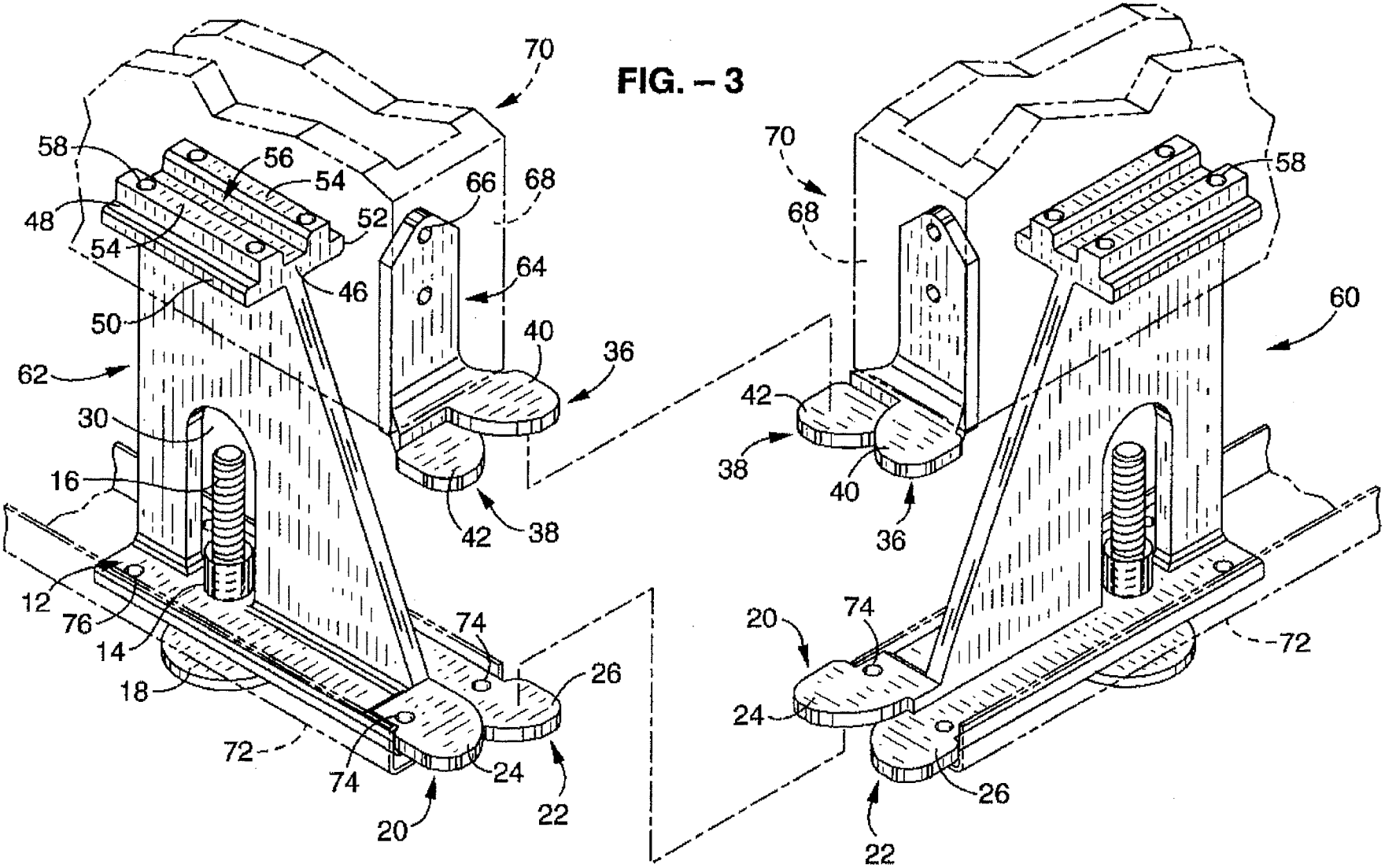
FIG. 3 is a perspective diagrammatic view showing an alternative embodiment of two disengaged interlock leveling devices in accordance with the present invention oriented for coupling in a right angle configuration.
Figure 4:
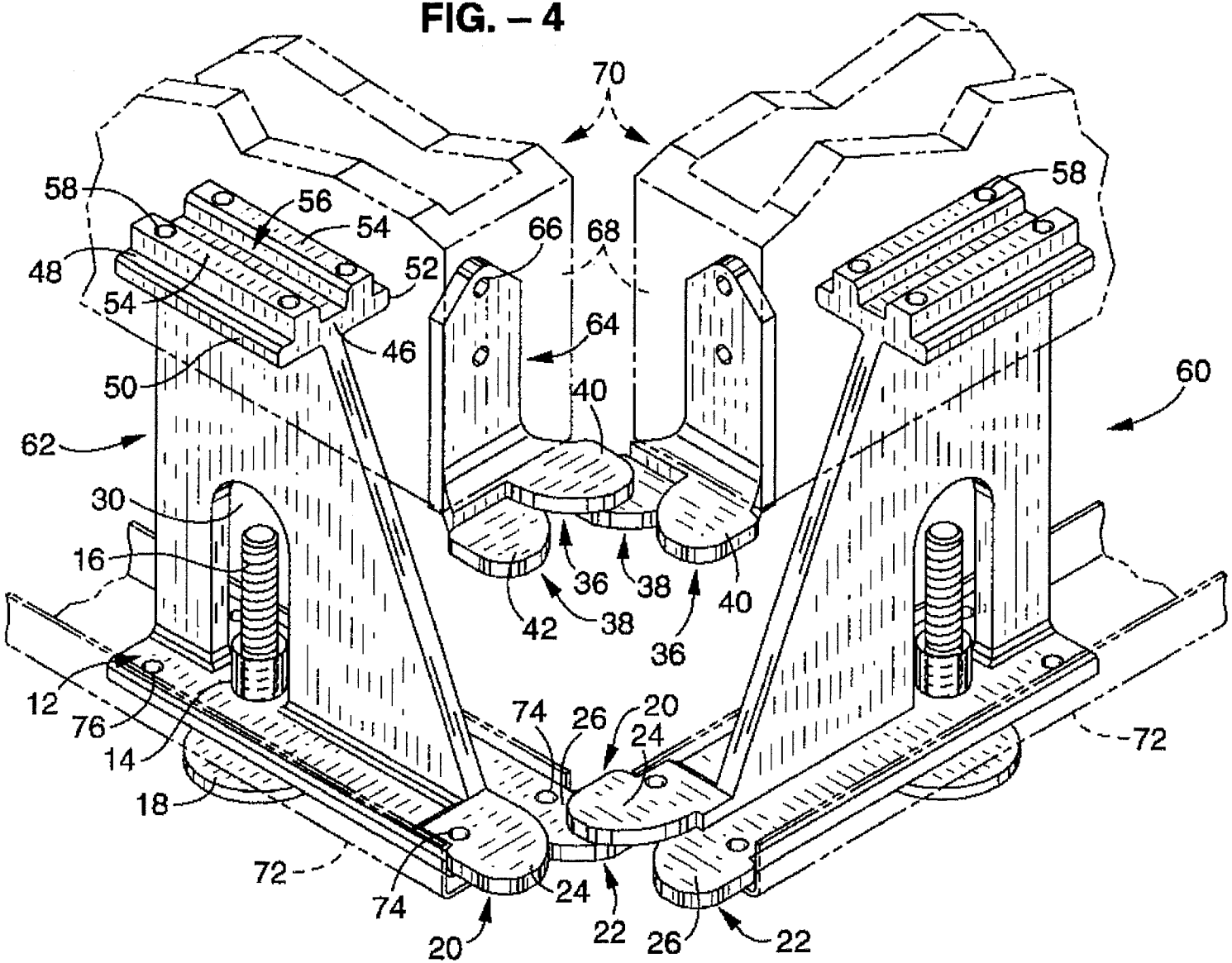
FIG. 4 is a perspective view showing the interlock leveling devices of FIG. 3 engaged in a right angle configuration.

Referring to FIG. 3 and FIG. 4, an alternative embodiment of the invention is shown where like reference numbers denote like parts. Here, two interlocking levelers 60 are shown in disengaged and engaged positions, respectively, oriented for coupling wall panels in a right angle configuration. In most respects, the interlock levelers 60 shown are the same as interlock levelers 10 previously described. However, in this embodiment front support member 30 has been eliminated and second upper and lower tabs 36 and 38 are separately coupled to the wall panel. A single support member 62, which is generally trapezoidal in shape, extends vertically from base platform 12 to support upper platform 46 and its associated structure.

Second upper and lower tabs 36 and 38 are joined to and extend outward from a vertical tab mounting plate 64 at generally right angles thereto to form an upper tab assembly. Tab mounting plate 64 is a generally planar member and includes a plurality of holes 66 for use with conventional fasteners for coupling tab mounting plate 64 to the end 68 of a wall panel 70. Alignment and spacing of second upper and lower tabs 36 and 38 in relation to first upper and lower tabs 20 and 22 is the same as in the embodiment shown in FIG. 1 and FIG. 2.

Further, in all embodiments an elongated cover rail 72 having a channel between its ends for receiving base platform 12 can be used to obscure base platform 12 and first upper and lower tabs 20 and 22 from view. To secure cover rail 72, upper and lower tabs 20 and 22 include holes 74 and base platform 12 incudes holes 74 for use with conventional fasteners.

Figure 5:
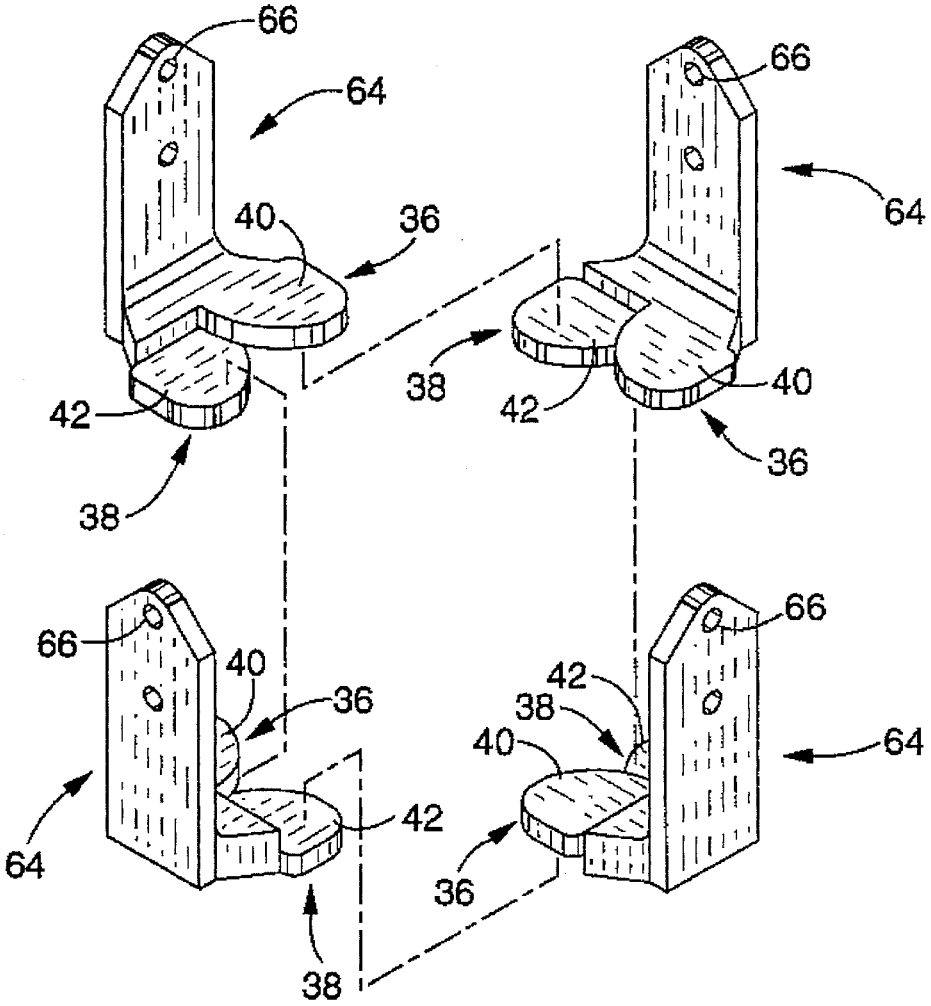
FIG. 5 is a perspective diagrammatic view showing four disengaged pairs of the upper leveling tab portion of the interlock leveling device shown in FIG. 3 oriented for coupling in a cross configuration.
Figure 6:
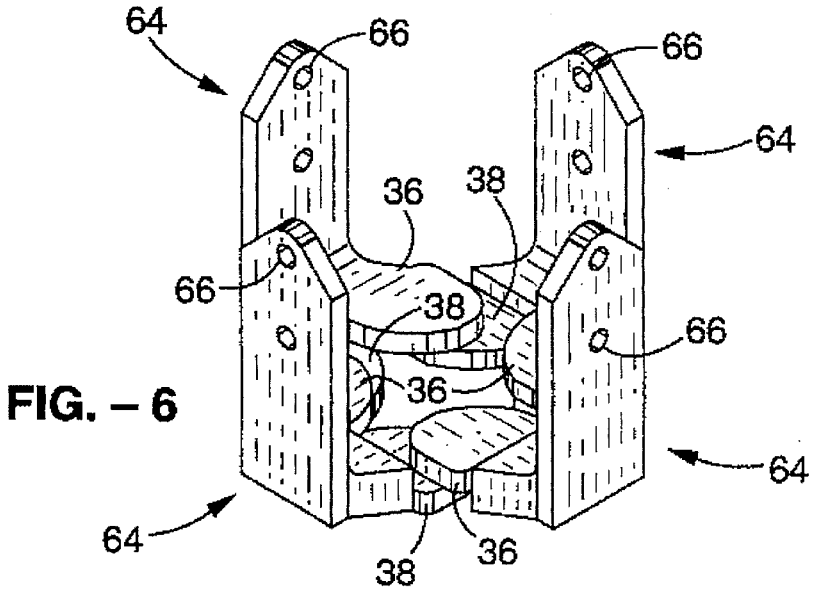
FIG. 6 is a perspective view showing the upper leveling tabs of FIG. 5 engaged in a cross configuration.

Referring now to FIG. 5 and FIG. 6, four of the detachable upper tab assemblies of the embodiment of FIG. 3 and FIG. 4 are shown oriented for leveling four wall panels in a cross configuration. FIG. 5 shows the tab assemblies disengaged, while FIG. 6 shows the tab assemblies engaged. Panel components are omitted from FIG. 5 and FIG. 6 to maximize the clarity of the interfitting and interlocking arrangement of the four upper tab assemblies. Each upper tab assembly shown in FIG. 5 and FIG. 6 is arranged so that another upper tab assembly is adjacent on each side, and thus each second upper tab 36 is adjacent to a second lower tab 38 from another upper tab assembly. Generally, the upper surface 42 of each second lower tab 38 fits intimately against the lower surface (not shown) of an adjacent second upper tab 36, so that they interfit and interlock in a generally square-shaped configuration. This configuration will impart to the attached panel components (not shown) a generally cross-shaped configuration, thereby permitting the intersection of four wall panels. As each of the tabs in the upper tab assembly are interfitted and interlocked, the corresponding tabs in the lower tab assembly (not shown) also interfit and interlock, to place the panel components in a level position. The height adjustment feet can be used to fine tune the leveling.

While the above embodiments show particular shapes of the support members 28, 30 and 62, it will be appreciated that a variety of other structures, configurations, and adaptations of a vertical support member are possible for use with the interlock leveler disclosed herein. It will also be appreciated that other mounting configurations for the upper and lower tab assemblies could be employed, and are contemplated as within the scope of this disclosure.

Since the invention disclosed herein may bear substantial loads, the materials used should preferably be aluminum, steel, metal alloys and the like. Portions or all of the apparatus, however, may be fabricated from natural or man-made polymers or composite materials thereof.

Accordingly, it will be seen that this invention provides a leveling device for wall panels which is easy to adjust, which provides substantial load carrying capability, and which does not have unsightly aesthetic characteristics. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An interlocking apparatus for leveling wall panels, comprising:

(a) a first leveling tab assembly, said first leveling tab assembly including a first upper tab and a first lower tab, each said tab having a top face and a bottom face, each said face lying in a plane, said plane of said bottom face of said first upper tab being adjacent to said plane of said top face of said first lower tab;

(b) a second leveling tab assembly, said second leveling tab assembly including a second upper tab and a second lower tab, each said tab having a top face and a bottom face, each said face lying in a plane, said plane of said bottom face of said second upper tab being adjacent to said plane of said top face of said second lower tab;

(c) a base platform, said first leveling tab assembly coupled to said base platform; and (d) a support structure, said support structure coupled to and extending from said base platform, said second leveling tab assembly coupled to said support structure, said support structure including means for coupling said support structure to a wall panel.

2. An interlocking apparatus for leveling wall panels, comprising:

(a) a first leveling tab assembly, said first leveling tab assembly including a first upper tab and a first lower tab, each said tab having a top face and a bottom face, each said face lying in a plane, said plane of said bottom face of said first upper tab being adjacent to said plane of said top face of said first lower tab;

(b) a second leveling tab assembly, said second leveling tab assembly including a second upper tab and a second lower tab, each said tab having a top face and a bottom face, each said face lying in a plane, said plane of said bottom face of said second upper tab being adjacent to said plane of said top face of said second lower tab;

(c) a base platform, said first leveling tab assembly coupled to said base platform;

(d) a support structure, said support structure coupled to and extending from said base platform, said support structure including means for coupling said support structure to a wall panel; and (e) a mounting plate, said second leveling tab assembly coupled to said mounting plate, said mounting plate including means for coupling said mounting plate to a wall panel.

3. An interlock leveler for wall panels, comprising:

(a) a first leveling tab assembly, said first leveling tab assembly including a first upper tab and a first lower tab, each said tab having a top face and a bottom face, each said face lying in a plane, said plane of said bottom face of said first upper tab being adjacent to said plane of said top face of said first lower tab, said first upper tab being vertically and horizontally offset from said first lower tab;

(b) a second leveling tab assembly, said second leveling tab assembly including a second upper tab and a second lower tab, each said tab having a top face and a bottom face, each said face lying in a plane, said plane of said bottom face of said second upper tab being adjacent to said plane of said top face of said second lower tab, said second upper tab being vertically and horizontally offset from said second lower tab;

(c) a base platform, said first leveling tab assembly coupled to said base platform; and (d) a support structure, said support structure coupled to and extending from said base platform, said second leveling tab assembly coupled to said support structure, said support structure including means for coupling said support structure to a wall panel.

4. An interlock leveler for wall panels, comprising:

(a) a first leveling tab assembly, said first leveling tab assembly including a first upper tab and a first lower tab, each said tab having a top face and a bottom face, each said face lying in a plane, said plane of said bottom face of said first upper tab being adjacent to said plane of said top face of said first lower tab, said first upper tab being vertically and horizontally offset from said first lower tab;

(b) a second leveling tab assembly, said second leveling tab assembly including a second upper tab and a second lower tab, each said tab having a top face and a bottom face, each said face lying in a plane, said plane of said bottom face of said second upper tab being adjacent to said plane of said top face of said second lower tab, said second upper tab being vertically and horizontally offset from said second lower tab;

(c) a base platform, said first leveling tab assembly coupled to said base platform;

(d) a support structure, said support structure coupled to and extending from said base platform, said support structure including means for coupling said support structure to a wall panel; and (e) a mounting plate, said second leveling tab assembly coupled to said mounting plate, said mounting plate including means for coupling said mounting plate to a wall panel.

5. A wall panel leveling apparatus, comprising:

(a) a base platform, said base platform including means for adjusting the height of said base platform above a surface;

(b) a first leveling tab assembly, said first leveling tab assembly including a first upper tab and a first lower tab, each said tab having a top face and a bottom face, each said face lying in a plane, said plane of said bottom face of said first upper tab being adjacent to said plane of said top face of said first lower tab, said first upper tab being vertically and horizontally offset from said first lower tab, said first leveling tab assembly coupled to said base platform; and (c) a second leveling tab assembly, said second leveling tab assembly including a second upper tab and a second lower tab, each said tab having a top face and a bottom face, each said face lying in a plane, said plane of said bottom face of said second upper tab being adjacent to said plane of said top face of said second lower tab, said second upper tab being vertically and horizontally offset from said second lower tab; and (d) a support structure coupled to and extending from said base platform, said second leveling tab assembly coupled to said support structure, said support structure including means for coupling said support structure to a wall panel, said second lower tab vertically aligned with said first upper tab, said second upper tab being vertically aligned with said first lower tab.

6. A wall panel leveling apparatus, comprising:

(a) a base platform, said base platform including means for adjusting the height of said base platform above a surface;

(b) a first leveling tab assembly, said first leveling tab assembly including a first upper tab and a first lower tab, each said tab having a top face and a bottom face, each said face lying in a plane, said plane of said bottom face of said first upper tab being adjacent to said plane of said top face of said first lower tab, said first upper tab being vertically and horizontally offset from said first lower tab, said first leveling tab assembly coupled to said base platform; and (c) a second leveling tab assembly, said second leveling tab assembly including a second upper tab and a second lower tab, each said tab having a top face and a bottom face, each said face lying in a plane, said plane of said bottom face of said second upper tab being adjacent to said plane of said top face of said second lower tab, said second upper tab being vertically and horizontally offset from said second lower tab;

(e) a support structure, said support structure coupled to and extending from said base platform, said support structure including means for coupling said support structure to a wall panel; and (f) a mounting plate, said second leveling tab assembly coupled to said mounting plate, said mounting plate including means for coupling said mounting plate to a wall panel, said second lower tab being vertically aligned with said first upper tab, said second upper tab being vertically aligned with said first lower tab.

* * * * *